United States Patent [19]

Barber et al.

[11] Patent Number: 4,513,960

[45] Date of Patent: Apr. 30, 1985

[54] UNDULATING AMUSEMENT RIDE APPARATUS

[76] Inventors: Gerald L. Barber, 10 Wittingtom Ct., Greenville, S.C. 29605; Wayne P. Comstock, 23 Selwyn Dr., Greenville, S.C. 29615

[21] Appl. No.: 542,671

[22] Filed: Oct. 17, 1983

[51] Int. Cl.[3] ..... A63G 1/34

[52] U.S. Cl. ..... 272/44

[58] Field of Search ..... 272/44, 45, 43, 36; 104/58, 63, 64, 65, 66

[56] References Cited

U.S. PATENT DOCUMENTS

| | | | |
|---|---|---|---|
| 1,107,287 | 8/1914 | Gibson | 272/44 |
| 1,337,820 | 4/1920 | Butcher | 272/44 X |
| 2,399,332 | 4/1946 | D'Errico | 272/44 |
| 2,659,601 | 11/1953 | Siverts | 272/36 |
| 2,765,168 | 10/1956 | Taylor | 272/36 X |
| 3,155,389 | 11/1964 | Winton | 272/44 |
| 3,235,251 | 2/1966 | De Shano | 272/44 |
| 3,666,264 | 5/1972 | Bartlett | 272/44 X |

*Primary Examiner*—Robert A. Hafer
*Assistant Examiner*—Arnold W. Kramer
*Attorney, Agent, or Firm*—Dority & Manning

[57] ABSTRACT

Apparatus for imparting an undulating motion to an amusement car unit travelling in a circular path is disclosed which includes an upper rotary hub (28) and a lower track rail (D) both of which are carried concentric about a rotary axis (X). The track rail (D) is carried adjacent the ground and supports a carrier arm (C) having a generally L-shaped configuration with one arm (48) pivotably attached to the rotating hub (28). A second cantilevered arm (50) joins the pivotably connected arm (48) at the elbow portion (52). The track rail (D) is formed by a closed perimeter rail (60) having varying radii of curvature. A lower glide bracket assembly (E) pivotably supports the carrier arm (C) above the track rail and by which the carrier arm travels around the rail. A car unit (B) carried on the cantilevered arm (50) is thus caused to move in a circular undulating motion as supported by the above described underneath structure.

10 Claims, 3 Drawing Figures

UNDULATING AMUSEMENT RIDE APPARATUS

BACKGROUND OF THE INVENTION

The invention relates to an amusement ride which undulates in an up-and-down pattern to cause a carrier car in which an occupant rides to rise and fall vertically while traveling in a generally circular path.

Heretofore, numerous amusement rides have been provided for carrying an occupant in a circular path while undergoing vertical undulations. For example, the conventional carousel in which one sits on a horse travelling in a circular path while going up-and-down is commonly known. U.S. Pat. No. 2,765,168 discloses a mechanism for effecting the circular and up-and-down movement of this kind of ride. This patented device employs a three cam lobe on which rollers ride for raising and lowering the carrier upon which the occupant rides. This type of mechanism and ride is suitable for a single carrier unit such as a horse or swing seat wherein the carrier unit may be suspended from overhead. Overhead mechanisms also leave a large number of operating parts exposed some of which carry grease all of which detracts from the ride.

The prior mechanisms for imparting up-and-down motion to a carrier unit in which an occupant rides have not been improved upon in recent years and these prior mechanisms have tended to be rather complicated and susceptible to failure due to the large number of moving parts and complicated natures of the mechanisms.

Accordingly, an important object of the present invention is to provide a simplified mechanism and apparatus for raising and lowering an occupant carrier car travelling in a curved path in which the apparatus acts from underneath the carrier unit.

Another important object of the present invention is to provide simplified and reliable apparatus for raising and lowering an occupant carrier unit of an amusement ride which can carry multiple occupants.

Yet another important object of the present invention is to provide apparatus for imparting a circular undulation motion to an amusement ride carrier unit which mounts beneath the carrier unit generally out of sight presenting an asthetically pleasing amusement ride.

Still another important object of the present invention is to provide a mechanism for imparting undulations to an amusement ride car unit carrying multiple occupants which supports and carries the car unit underneath yet which still permits the car unit to be carried close to the ground for young children.

SUMMARY OF THE INVENTION

The above objectives are accomplished according to the present invention by providing a base frame assembly by which a central drive shaft is rotatably carried. A rotating hub is affixed to the drive shaft and a plurality of circumferentially spaced carrier arms are carried by the hub. A closed-loop track rail is carried underneath the rotating hub means closely adjacent the ground generally concentric with the rotary axis of the rotating hub. An occupant car unit is carried by the ride supporting carrier arm. The carrier arm is generally "L"-shaped and includes a pair of arm elements joining together in an apex portion. A first of the arm elements is pivotably attached to the rotating hub and a second of the arm elements extends from the first arm element in a cantilevered manner terminating in a free end. The second arm element extends radially from the rotary axis of the rotating hub and above the rail track. The car unit is supported on the free end portion. A glide mechanism pivotably connects the carrier arm and the track rail. The track rail has different radii from the rotary axis of the hub means causing the glide mechanism to pivot and alternately raise and lower the carrier car in an undulating motion. The glide mechanism supports the car unit from beneath above the track rail and ground.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
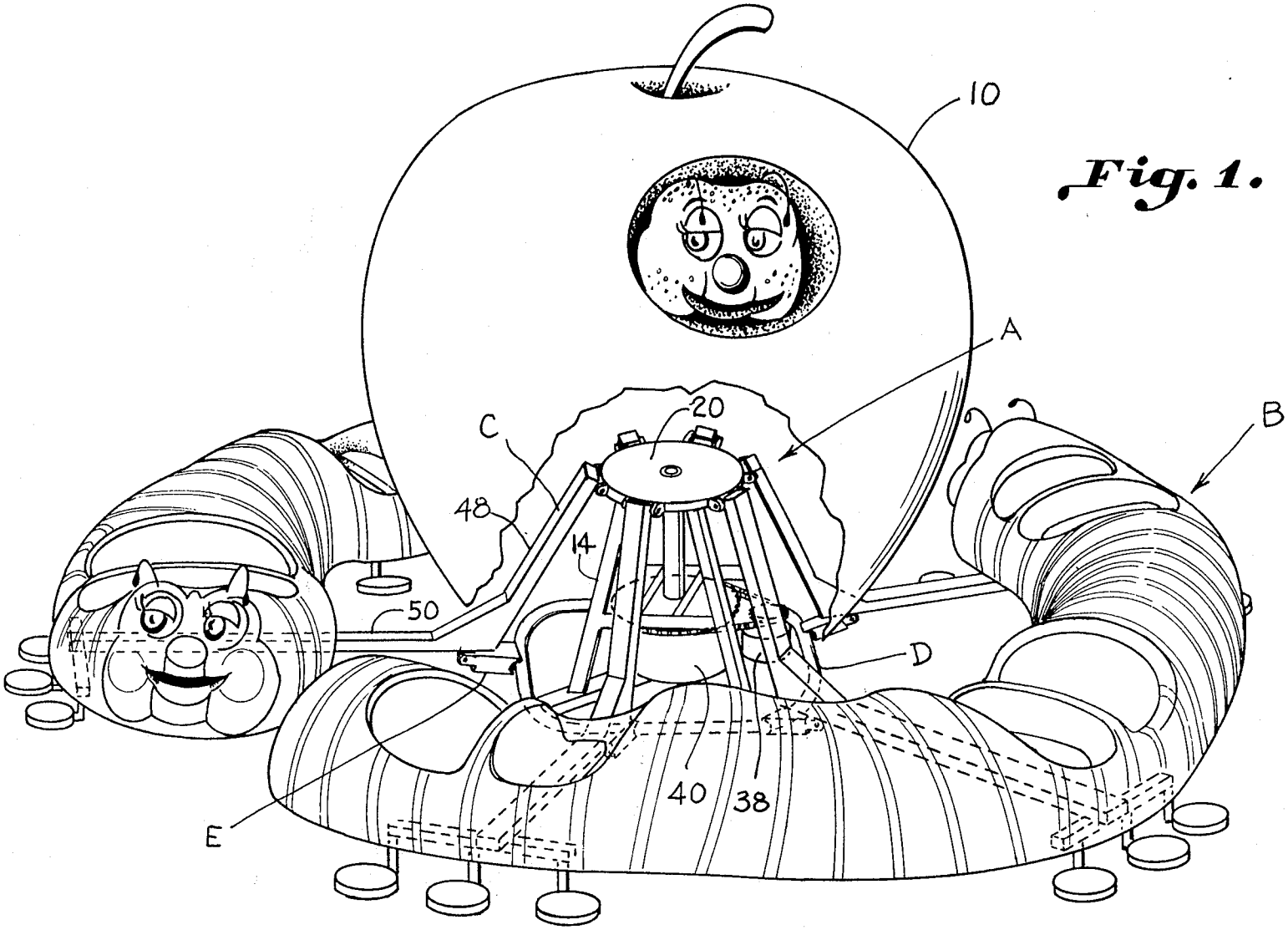
FIG. 1 is a perspective with parts cut away illustrating the amusement ride apparatus constructed in accordance with the present invention.

The invention is directed to an amusement ride for carrying an occupant in a car unit which travels in a circular path and is raised and lowered in an undulating motion.

The drawings illustrate an amusement ride having a central decorative member 10 which is illustrated in the form of an apple with a fanciful worm figure. The decorative member serves as a housing for covering apparatus, designated generally as A, which imparts a circular undulating motion to car unit(s), designated generally as B, in which the occupants ride.

Referring now in more detail to the drawings, a base frame member 12 is illustrated which supports the apparatus. There is an upstanding A-frame 14 carried by the base frame 12 which includes a pair of standards 16 and 18 inclined inwardly and upwardly which are integrally attached by a horizontal plate 20. A cross-frame member 22 interconnects the legs 16 and 18. The plate 20 includes a bearing block 24 in which a drive shaft 26 is rotatably received. The shaft 26 terminates in a drive end on which a rotating hub means 28 is affixed for rotation with the shaft 26. Shaft 26 is connected on its opposite end to a main gear 30 which is driven by a chain 32. Chain 32 is, in turn, driven by a sprocket 34 connected to a drive shaft 36 of a drive motor 38 which is typically an electric motor. The main gear 30 is carried on a hub 40.

Circumferentially spaced on the hub 28 is a plurality of carrier arms C in the form of arms 42 which are pivotably attached to the hub 28 by means of pivot connections in the form of pivot brackets 44 and pivot pin 46 extending through the brackets and a sleeve 47 which may be affixed to the end of the arm 42. Carrier arms 42 include a first arm element 48 which is pivoted to hub 28 and a second arm element 50 extending outwardly from the arm element 48. The arm elements 50 and 48 are joined together at an apex elbow portion 52.

As illustrated, the arm elements 48 and 50 make an obtuse angle with respect to each other.

Track means D is provided by a closed-loop track rail 60 carried by the frame means below the carrier arm 42. The closed-loop track rail D has an open center but a closed perimeter. The carrier arms C travel around the track rail and are supported thereon by means of a glide mechanism and bracket assembly E. Track rail 60 is preferably of rounded or circular cross-section.

The glide bracket assembly E includes a roller bracket 61 connected to the second arm 50 of the carrier arm C by means of a pivot bracket 62 and pivot pin 64. The roller bracket 61 includes an arm 66 which is pivotably attached by means of pin 64 to the pivot bracket 62. The roller bracket 61 includes a roller pin 68 and a roller 70 which is rotatably carried about the pin 68.

Figure 2:
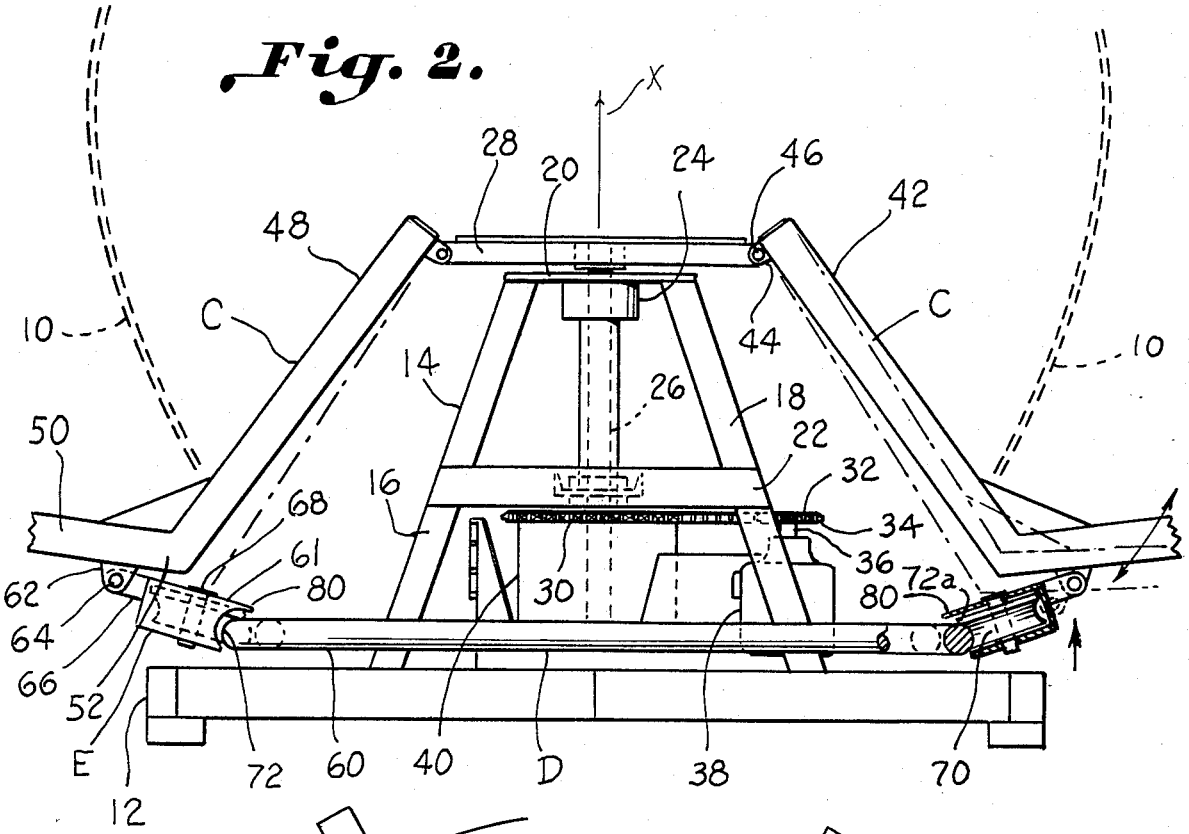
FIG. 2 is a front elevation of an amusement ride apparatus for imparting a circular and undulating motion to a car unit or units of an amusement ride.
Figure 3:
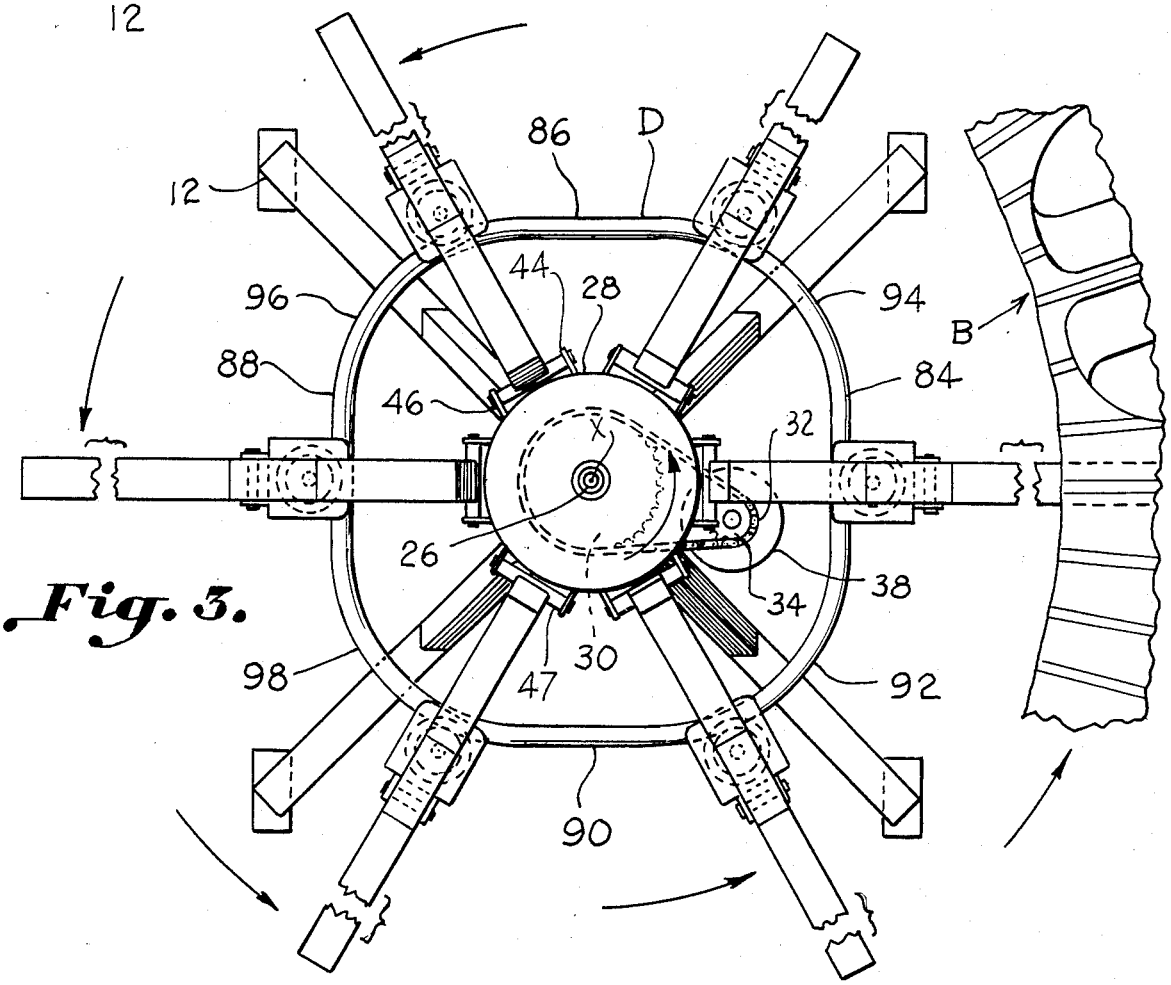
FIG. 3 is a top plan view of the apparatus of FIG. 2.

The roller 70 includes a V-shaped groove 72 which serves as a roller guide groove for receiving the rounded contour of the track rail D. The roller is tapered to have a larger diameter and lip 72*a* at the top to fit over and stay on the rail, as can best be seen in FIG. 2.

The roller bracket 61 includes an outwardly extending lip 80 which extends over the track rail 60 so as to maintain and retain the bracket and top roller lip 72*a* on the track rail with the rail received in the generally V-shaped groove of the roller 70.

As thus constructed, a vertical lifting force is exerted on the carrier arm C against the supporting rail 60 by means of the glide mechanism E. The roller 70 acting on the rail supports the carrier arm C in a cantilevered position during movement of the ride in a circular path.

The track rail 60 includes a closed perimeter rail of different radii from the axis X of the rotary drive. The track rail 60 includes four generally straight sections 84, 86, 88, and 90 and four curved sections 92, 94, 96, and 98. The curved sections have a greater radius of curvature from the rotary axis X than does a point on the straight sections. The carrier arm C is caused to be pivoted upwardly by the curved sections due to the pivoting of the roller bracket 61 about the curved sections to an upwardly tilted position. On the straight sections the roller bracket 61 pivots to a substantially horizontal position and causes, the carrier arm C to be lowered such that an undulating effect and motion is imparted to the carrier arm by means of track D and glide mechanism E.

While a preferred embodiment of the invention has been described using specific terms, such description is for illustrative purposes only, and it is to be understood that changes and variations may be made without departing from the spirit or scope of the following claims.

What is claimed is:

1. In an amusement ride device comprising:

base frame assembly means;

a driven vertical drive shaft rotatably carried by said base assembly;

hub means carried by the upper portion of said drive shaft;

ride supporting carrier arms pivoted to said hub means;

non-circular closed-loop track means carried by said base frame assembly means underneath said carrier arms having a track rail encircling said vertical axis;

a ride car unit carried by each said ride supporting carrier arm;

each said carrier arm including a pair of arm elements joined together at an apex portion;

a first of said arm elements having an upper end pivotally connected to said hub means;

a second of said arm elements having a free end extending away from said apex portion and on which end said car unit is carried above said second arm element;

glide mechanism means pivotally carried by said carrier arm directly beneath said apex portion for pivotably interconnecting said carrier arm and said track means so that said carrier arm is supported thereby in a cantilevered manner;

whereby said carrier arms and passenger carrier means are vertically undulated on rotation of said vertical drive shaft.

2. The device of claim 1 wherein said track rail includes linear parallel side sections joined by curved sections wherein said curved sections have a greater radius of curvature than points on said straight sections with respect to said rotary drive axis.

3. The device of claim 1 wherein said track rail includes a closed loop rail which is open inside its perimeter.

4. The device of claim 3 wherein said glide mechanism means includes a glide roller and a glide roller bracket assembly for carrying said glide roller, said glide roller having a V-groove about its circumference which rides on said track rail, wherein said track rail has a circular cross-section and is received in the V-groove of said glide roller.

5. The device of claim 4 wherein said glide bracket assembly includes a pivot bracket pivotably carried by said carrier arm element adjacent said apex portion, a roller housing carried by said pivot bracket in which said V-grooved guide roller is rotatably carried.

6. The apparatus of claim 4 wherein said glide roller is tapered having a top surface and a bottom surface, said top surface having a larger diameter than said bottom surface, and said V-groove formed in said glide roller between said surfaces which rides upon and receives said rail.

7. The device of claim 1 wherein said first and second arm elements form an obtuse angle with each other.

8. The device of claim 1 wherein said track means includes said track rail consisting of a closed loop rail carried about the face of said frame assembly means adjacently above said base frame member, said carrier arm being supported above said rail by said glide mechanism means so that said rail exerts an upward lift force on said carrier arm to support said ride car above the ground as carried adjacent said free end portion of said carrier arm.

9. The apparatus of claim 1 wherein said track means includes a closed loop track rail having a generally square-oval configuration wherein the perimeter is closed but open in the interior thereof.

10. An amusement ride device comprising:

a vertical shaft means;

a horizontal non-circular closed-loop track means at substantially ground level encircling a lower end of said shaft means;

a plurality of carrier arms each pivotally connected to an upper portion of said vertical shaft means;

a plurality of rotatable means riding on said track means each connected to and supporting a respective carrier arm;

a plurality of passenger carrier means each mounted on the upper surface adjacent the outer end of a respective arm, and means for rotating said vertical shaft whereby the arms and passenger carrier means are vertically undulated on rotation of said shaft.

* * * * *